US005366227A

United States Patent [19]

Duffy

[11] Patent Number: 5,366,227

[45] Date of Patent: Nov. 22, 1994

[54] RECYCLING GAME

[76] Inventor: Patrick Duffy, 214 Duncan Ct., Longwood, Fla. 32779

[21] Appl. No.: 228,707

[22] Filed: Apr. 18, 1994

[51] Int. Cl.[5] ..... A63F 3/00; A63F 1/10

[52] U.S. Cl. ..... 273/287; 273/288; 273/148 A; 446/470; 446/424

[58] Field of Search ..... 434/127, 178, 429; 273/148 A, 287, 236, 945, 288, 250–254; 446/427, 470, 471, 95, 88, 275, 424

[56] References Cited

U.S. PATENT DOCUMENTS

| | | | |
|---|---|---|---|
| 3,223,420 | 12/1965 | Turner | 273/253 |
| 3,497,967 | 3/1970 | Lewis | 434/178 |
| 3,895,805 | 7/1975 | Enos | 273/236 |
| 4,643,430 | 2/1987 | D'Aloia | 273/252 |
| 5,088,739 | 2/1992 | Mitchell | 273/248 |

*Primary Examiner*—Benjamin H. Layno
*Attorney, Agent, or Firm*—William M. Hobby, III

[57] ABSTRACT

A recycling game apparatus includes a toy vehicle having a plurality of bins for holding game pieces and having a card caddy thereon. A deck of cards is supported in the toy vehicle card caddy along with a plurality of game pieces with each game piece having a shaped emulative of a recycling member and stored in a marked bin. The game pieces can be moved into and out of the bins in playing the game. Each card in the deck of cards has information concerning one recycling item which is emulative of at least one game piece, such as aluminum, newspaper, glass, or plastic. Each toy vehicle plurality of bins may be marked with indicia to indicate aluminum, paper, glass, plastic, or trash. The toy vehicle is used to store the game with cards and pieces as well as used in playing the game.

10 Claims, 1 Drawing Sheet

RECYCLING GAME

BACKGROUND OF THE INVENTION

The present invention relates to a recycling game and especially to a recycling game using a toy vehicle, recycling game pieces and cards.

In the past, a wide variety of games have been provided including a variety of simulated games, such as simulative basketball, golf, and football. Other games that have been widely used include those that have projectiles and targets which generally involve the throwing of a projectile at some type of target along with the keeping of scores. A large number of games fall within the category of board games which include boards for playing a game thereupon and frequently include a spinner or dice along with playing cards and game pieces. Board games are sometimes merely word games, such as scrabble or dictionary, or test one's knowledge, such as the trivia type games. Some games are also learning type games which are directed towards educating the participants within a limited area and the present game falls within this category in that it educates the players on recycling and is played with game pieces and a toy vehicle which are emulative of recycle items and includes cards which educate the players on recycling and the handling of trash and garbage.

One prior art U.S. Pat. No. 5,088,739 is a game having an environmental theme in which the players work together to solve environmental crisis within a specified number of terms. This is a board game in which the players travel along world boards until the environmental crisis are solved.

SUMMARY OF THE INVENTION

A recycling game apparatus includes a toy vehicle having a plurality of compartments or bins for holding game pieces and having a card caddy thereon. A deck of cards is supported in the toy vehicle card caddy along with a plurality of game pieces with each game piece having a shape emulative of a recycling member. Each card in the deck of cards has information concerning one recycling item and deals with one of the game pieces, such as aluminum, newspaper, glass, or plastic. Each toy vehicle plurality of bins may be marked with indicia to indicate aluminum, paper, glass, plastic, trash or garbage. The toy vehicle is used to store the game with cards and game pieces as well as used in playing the game.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
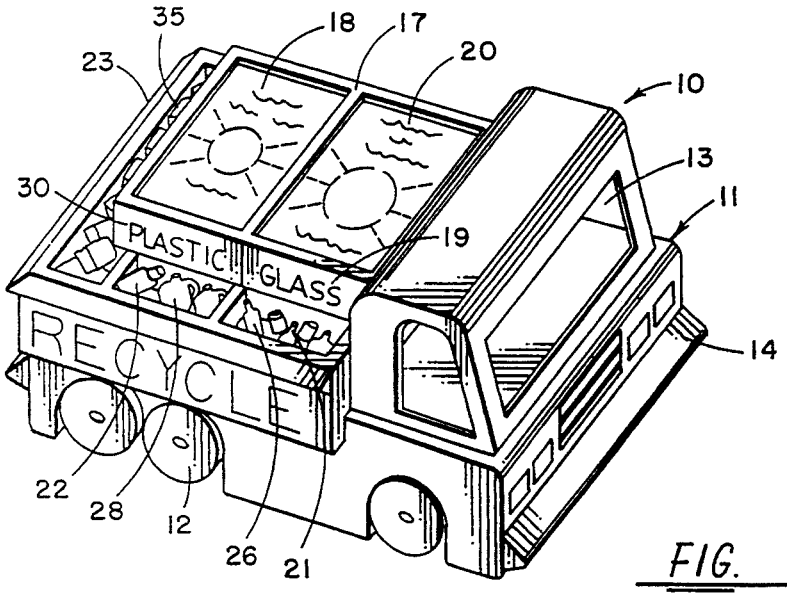
FIG. 1 is a perspective view of the game in accordance with the present invention.
Figure 2:
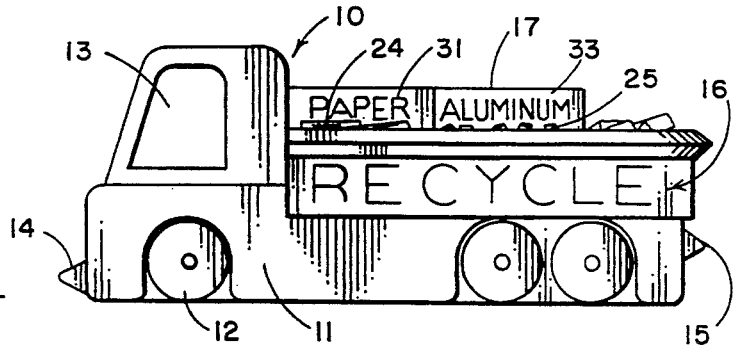
FIG. 2 is a side elevation of the toy vehicle of FIG. 1.

Referring to the drawings and especially to FIGS. 1 and 2, a game 10 has a toy vehicle 11 which is somewhat emulative of a recycle collection truck, even though it does not resemble any known truck. The toy vehicle 11 has wheels 12, a cab portion 13, a bumper 14 in the front and bumper 15 in the rear and has indicia 16 on each side thereof stating "recycle". The truck bed has a card caddy 17 which is shown having compartments for a playing deck of cards 18 and a discard deck 20, both supported therein face down in the card caddy. The card caddy 17 is located in the middle of the truck bed and is surrounded by a plurality of bins 21, 22, 23, 24, and 25. Bin 21 has a plurality of game pieces 26 therein and indicia 19 thereover stating "glass". Game pieces 26 are emulative of glass bottles or the like made in miniature. Bin 22 is filled with a second group of game pieces 28 emulative of plastic containers but in miniature and has the indicia 30 adjacent the bin 22 setting forth "plastic". Similarly, the compartment 24 has indicia 31 adjacent thereto stating "paper" and is filled with game pieces emulative of newspaper 32, but on a much smaller scale. The game compartment 25 has the indicia 33 adjacent thereto stating "aluminum" and is filled with game pieces 34 emulative of aluminum cans in miniature. Bin 23 has game pieces 35 therein emulative of paper garbage bags.

Figure 3:
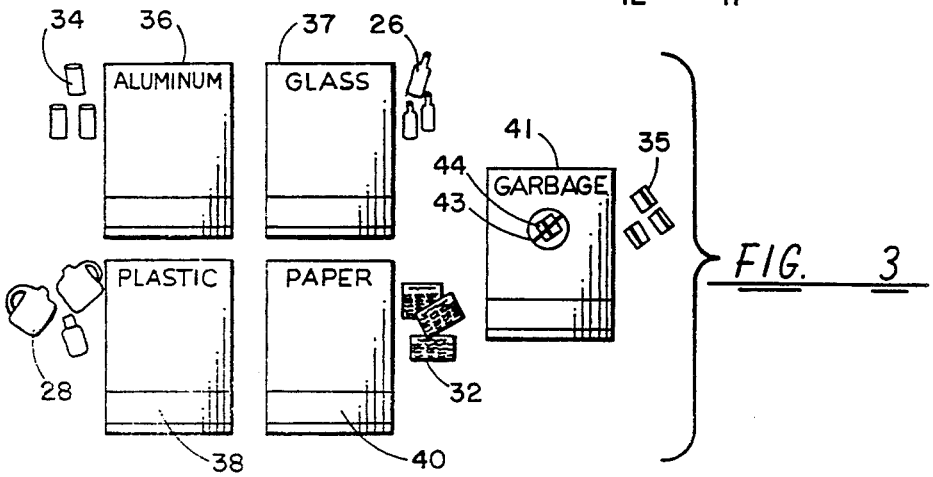
FIG. 3 is a top plan view of cards and game pieces removed from the toy vehicle of FIGS. 1 and 2.

The game pieces for aluminum 34, glass 26, paper 32 and plastic 28 are all illustrated removed from the toy vehicle 11 in FIG. 3 along with five of the playing cards, aluminum cans 36, glass 37, plastic 38, and newspaper 40. Each of the cards has educational material placed thereon dealing with the particular subject of the card. For instance, the aluminum card 36 might have a statement dealing with the recycling of aluminum. A super recycler card 41 has a garbage can indicia 44 printed thereon with a "no garbage" symbol 43 and may contain information on garbage.

An example of information provided on the cards can include, for instance, an aluminum card 36 containing a statement that "it takes 95% less energy to recycle an aluminum can than to make a new one" or on the glass card, it might state that "the energy saved from recycling one glass bottle will power a 100 watt lightbulb for four hours".

In operation, the game can be played by bringing out the game with vehicle 10 with all of the cards 18 and 20 and all of the game pieces stored therein and then removing the game pieces for each player for playing the game. Cards are drawn by each player and the game pieces are placed in or removed from the proper bins on the truck. The object is to be the first player to recycle all his game pieces exclusive of garbage pieces before collecting three bags of garbage. The game cards are drawn in turns and are read aloud. Garbage pieces are the ones to be avoided and the game can be ended by a player collecting three bags of garbage while the remaining players continue. The game may be played by each player taking a card and reading the environmental information to other players. The player then places a piece emulative of the card that he has drawn in the appropriate bin on the toy vehicle 11 and puts the card face down in the discard card bin. One of the caddy card containers can be for drawing cards and the other for placing discards. Each player repeats the step. Players also repeat the remaining order of the recycling bins, such as if an aluminum card is drawn, the player might say "aluminum, paper, glass, plastic". The play continues until a player cannot say the correct order of all the previous cards. A player may be penalized for not recycling and would take from the toy vehicle 11 one bag of garbage 35. The player who collects three bags of garbage is out and the remaining players continue. A player may also pick a super recycler 41 card. The first player to recycle all of their pieces excluding the garbage without collecting three bags of garbage wins the game. It will, of course, be clear that the game can be played in any manner desired and variations on the game can be played using the same toy vehicle, game components, and cards without departing from the spirit and scope of the invention.

Accordingly, the present invention is not to be construed as limited to the forms shown which are to be considered illustrative rather than restrictive.

I claim:

1. A recycling game comprising:

a toy vehicle having a plurality of bins for holding game pieces and having a card caddy thereon;

a plurality of cards supported in said toy vehicle card caddy;

a plurality of game pieces, each game piece having a shape emulative of a recycling member and stored in one said toy vehicle bin;

each card having information concerning one recycling item which is emulated by at least one game piece whereby a game can be played which teaches players about recycling.

2. The recycling game in accordance with claim 1 in which a plurality of game pieces are emulative of aluminum cans.

3. The recycling game in accordance with claim 2 in which a plurality of game pieces are emulative of newspapers.

4. The recycling game in accordance with claim 3 in which a plurality of game pieces are emulative of glass items.

5. The recycling game in accordance with claim 4 in which a plurality of game pieces are emulative of plastic items.

6. The recycling game in accordance with claim 5 in which a plurality of game pieces are emulative of garbage bags.

7. The recycling game in accordance with claim 6 in which there is one deck of cards separated into two stacks of cards, each stack positioned separately in said toy vehicle card caddy.

8. The recycling game in accordance with claim 1 in which a toy vehicle has indicia thereon indicating the contents for each bin including a bin for aluminum, glass, paper and plastic.

9. The recycling game in accordance with claim 8 in which said card caddy in position in said toy vehicle in the center portion thereof partially surrounded by said bins.

10. The recycling game in accordance with claim 8 in which said toy vehicle has indicia thereon indicating the toy vehicle is a recycle truck.

* * * * *